United States Patent [19]

Di Stefano

[11] Patent Number: 4,537,831

[45] Date of Patent: Aug. 27, 1985

[54] CROSSLINKING OF CHLORINE-CONTAINING POLYMERS

[75] Inventor: Frank V. Di Stefano, Macungie, Pa.

[73] Assignee: Air Products and Chemicals, Inc., Allentown, Pa.

[21] Appl. No.: 582,427

[22] Filed: Feb. 22, 1984

[51] Int. Cl.[3] ..... C08L 27/04; C08L 27/06; C08L 27/08

[52] U.S. Cl. ..... 428/514; 428/181; 428/288; 525/202; 525/203; 525/217

[58] Field of Search ..... 525/217, 203, 232; 428/511, 514, 181, 288

[56] References Cited

U.S. PATENT DOCUMENTS

| | | | |
|---|---|---|---|
| 2,926,161 | 2/1960 | Butler et al. . | |
| 3,410,811 | 11/1968 | Bufton et al. . | |
| 3,700,623 | 10/1972 | Keim . | |
| 3,833,531 | 9/1974 | Keim . | |
| 3,968,317 | 7/1976 | Dumas | 428/514 |
| 4,167,610 | 9/1979 | Bolto et al. . | |
| 4,277,529 | 7/1981 | Friedman | 428/511 |
| 4,296,225 | 10/1981 | Rhum | 428/511 |
| 4,328,284 | 5/1982 | LePoutre | 428/511 |

*Primary Examiner*—Allan M. Lieberman

*Attorney, Agent, or Firm*—Michael Leach; James C. Simmons; E. Eugene Innis

[57] ABSTRACT

The binder composition for nonwoven products comprising a vinyl chloride-ethylene copolymer emulsion and up to 25 wt %, based on emulsion solids, of a polyamine containing 5 or 6 member N-heterocyclic moieties prepared by the polymerization of at least one diallylamine of the formula

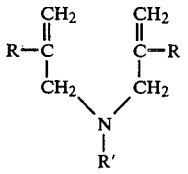

where R is hydrogen or a $C_1$–$C_4$ alkyl group and R′ is hydrogen or a methyl group.

16 Claims, No Drawings

CROSSLINKING OF CHLORINE-CONTAINING POLYMERS

TECHNICAL FIELD

The invention relates to the crosslinking, or curing, of chlorine-containing polymers with an amine-containing crosslinking agent.

BACKGROUND OF THE INVENTION

An important use of vinyl chloride polymers is as a binder for nonwovens such as a paper saturant in making filter paper for air and oil filters. Such filters bonded with vinyl chloride polymer saturants and pleated should resist delamination and splitting. A further requirement is wet strength.

One of the problems with the use of chlorine-containing emulsion polymers such as vinyl chloride polymers in the saturation of fibrous substrates is the need to enhance the physical properties, particularly the wet strength of the polymers.

In the past, addition of melamine-formaldehyde resin to the emulsion has been used to improve the wet strength of the polymer. The resulting composition provided adequate wet strength but yielded a brittle product with poor flexural strength. The delamination resistance of the saturated fibrous substrate was also poor. Additionally, there was opposition in the industry due to the formaldehyde content of the resins because of possible toxicity and the high temperature required to obtain optimum properties.

It is also known to improve the properties of vinyl chloride polymers by crosslinking them with linear aliphatic polyamines such as polyethylenimine.

U.S. Pat. No. 3,410,811 discloses a granular, polyvinyl chloride-based anion exchange resin prepared by reacting a polyvinyl chloride resin with an aqueous solution of ammonia or aliphatic mono- and polyamines having less than 13 carbon atoms per molecule, at a temperature of at least 100° C. and subsequently further reacting the aminated polyvinyl chloride resin with a polyfunctional compound having at least two amine-reactive groups.

U.S. Pat. Nos. 3,833,531 and 3,968,317 are representative of the art which shows reaction between a diallylamine polymer and an epihalohydrin such as epichlorohydrin.

U.S. Pat. No. 4,167,610 discloses reacting an allylamine type polymer with an organic dihalo compound to obtain an ion exchange resin.

SUMMARY OF THE INVENTION

The invention provides a binder composition for nonwoven fibrous substrates comprising a chlorine-containing polymer binder and an amine crosslinking agent which is a polyamine polymer containing 5 or 6 member N-heterocyclic moieties.

Such binder compositions when applied to a nonwoven web of fibers and cured provides the following advantages:

- a more flexible product is obtained since the formation of a brittle matrix is avoided by the absence of self-condensation of the crosslinker as with melamine-formaldehyde crosslinkers,
- the crosslinking reactivity of the polyamine due to piperidine and pyrrolidine moieties affords curing at lower temperatures,

- greater crosslink density is obtained which results in enhanced chemical resistance,
- pleated paper bonded with such binder compositions resists delamination and splitting, and
- enhanced wet strength is shown.

DETAILED DESCRIPTION OF THE INVENTION

In accordance with this invention nonwoven binder compositions are provided that can be used as a paper saturant in the production of filter paper and air and oil filters in which the major component of the binder composition is a chlorine-containing polymer. The properties of such chlorine-containing polymer are improved by combining it with up to about 25 wt. % of a polyamine polymer containing 5 or 6 member N-heterocyclic groups, i.e., pyrrolidine and piperidine moieties.

Such amine polymers can be obtained by polymerizing at least one diallylamine of the formula:

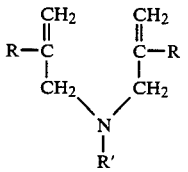

where R is hydrogen or a $C_1$–$C_4$ alkyl group and R′ is hydrogen or a methyl group.

Examples of diallylamines of the above formula include 2,2′-dimethyldiallylamine, 2,2′-diethyldiallylamine, 2,2′-dipropyldiallylamine, 2,2′-diisobutyldiallylamine, N-methyldiallylamine, 2,2′-dimethyl-N-methyldiallylamine, 2,2′-diethyl-N-methyldiallylamine and diallylamine which is the preferred monomer for polymerization.

Diallylamine polymers are known in the art as are methods for their preparation. See U.S. Pat. Nos. 2,926,161 and 3,700,623 which are incorporated by reference.

The diallylamine polymers which are produced will contain units of the following formulae:

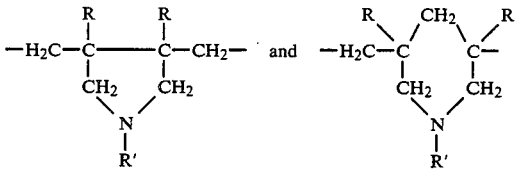

where R and R′ are as defined above. These formulae represent the pyrrolidine and the piperidine moieties of the polymer, respectively. It is believed that the piperidine moiety will be the predominant N-heterocyclic moiety in the polymer.

It is preferred that poly(diallylamines) of higher molecular weight, i.e. about 70,000 to 120,000, be used. In addition, copolymers of diallylamines with up to about 40 wt. % copolymerizable monomers such as vinyl acetate are also suitable.

In preparing the binder compositions of the invention, up to about 25 wt. %, preferably 1 to 10 wt. % of the diallylamine polymer is mixed with a chlorine-containing polymer emulsion, on a solids basis. Polymer emulsions which are suitable for practicing the invention include the aqueous emulsions of vinyl chloride homopolymers and copolymers, particularly vinyl chloride-ethylene copolymers containing 5 to 35 wt. % ethylene, vinylidene polymers and chlorinated acrylic polymers. It is preferred to use those chlorine-containing polymers which are readily commercially available although any of the procedures known in the art for preparing such polymers can be used.

The chlorine-containing polymer emulsion and the 5 and/or 6 member N-heterocyclic containing polyamine are simply combined in the stated proportions and applied to a nonwoven web of synthetic or natural fibers, such as polyester or cellulosic fibers in amounts from 5 to 80 wt. %, solids on paper, by application methods well known in the art such as spraying, dipping and printing.

Although crosslinking of the polymer composition can occur at room temperature due to the higher reactivity of the N-heterocyclic moieties with the chlorine atoms in the chlorine-containing polymers, the crosslinking and curing action can be performed at temperatures ranging from 70° to 150° C. Other components which optionally can be included in the binder composition for the nonwoven product include surfactants and pigments typically used in the art.

The following examples are merely illustrative of the invention and not limitive:

EXAMPLE 1

This example shows the homopolymerization of diallylamine. De-ionized water (300 g) and diallylamine (300 g) were added to a 1 liter beaker with agitation provided by a magnetic stirring bar. Concentrated sulfuric acid was added to this mixture until a pH of 2.0 was achieved. The percent solids was reduced to 40% by the addition of water (150 g) and the pH was readjusted to 2.0.

The mixture was transferred to a 1 liter water-jacketed reactor and purged with subsurface nitrogen for 30 minutes. During this time the mixture was stirred at 200 rpm with a mechanical agitator. The agitation was then increased to 300 rpm and a delay addition (incremental addition over a period of time) of a redox system comprising 5% aqueous hydrogen peroxide and 10% aqueous sodium formaldehyde sulfoxylate was used to initiate and maintain polymerization at 55° C. The addition of the redox system was discontinued when the isotherm subsided at which time 60 ml of the 5% hydrogen peroxide and 80 ml of the sodium formaldehyde sulfoxylate solutions had been added.

The cooled reaction mixture was brought to a pH of 12 with potassium hydroxide. The free diallylamine polymer separated as a viscous upper layer which was decanted, washed with water and then purged with air to remove residual monomer.

EXAMPLE 2

The diallylamine polymer of Example 1, a polyethylenimine (acyclic), and a melamine-formaldehyde crosslinking agent were compared as crosslinking agents for Airflex ®-4514 polymer emulsion which is a vinyl chloride-ethylene copolymer emulsion, 50% solids and 20% ethylene based on copolymer, marketed by Air Products and Chemicals, Inc. The various crosslinking agents were blended with the vinyl chloride-ethylene copolymer emulsion at a level of 5 wt. % on a dry basis. The blended compositions were then applied to a Teflon sheet and cured. The free films were tested for swell index (solvent swollen wt./dry wt.) and % solvent insolubles by solvent submersion or Soxhlet extraction. From Table 1 it can be seen that the diallylamine polymer crosslinked composition showed a far lower swell index than the other compositions indicating that the crosslinking density of the cured composition was much higher. Similarly the higher insolubles value which was obtained with the diallylamine polymer containing composition demonstrated higher crosslinking.

TABLE 1

| CROSSLINKER (5% dry wt.) | CURE CONDITIONS | SOL-VENT | SWELL INDEX | INSOL-UBLES, % |
|---|---|---|---|---|
| Example 1 | 2 days rt | DMF | 2.5 | |
| PEI-12 | 2 days rt | DMF | 4.6 | |
| Resimene 841 | 2 days rt | DMF | Dissolved | |
| Example 1 | 1 week rt | THF | 7.2 | 40.2 |
| PEI-12 | 1 week rt | THF | 27.6 | 32.7 |
| Resimene 841 | 1 week rt | THF | 12.4 | 31.3 |
| Example 1 | 35 min. 300° F. | THF | 3.3 | 53.2 |
| PEI-12 | 35 min. 300° F. | THF | 8.9 | 47.5 |
| Resimene 841 | 35 min. 300° F. | THF | 20.9 | 37.6 |

PEI-12 is a polyethylenimine marketed by Aceto Chemical Co.
Resimene 841 is a melamine-formaldehyde marketed by Monsanto Corp.
DMF = dimethylformamide
THF = tetrahydrofuran In addition the solvent resistance of the three crosslinked vinyl chloride-ethylene copolymer systems were evaluated by contacting the polymer film with solvent for 3 minutes and abrading the solvent soaked film with a wooden tongue depressor. Table 2 shows that the diallylamine polymer containing composition provided a film which demonstrated greater resistance to solvent attack.

TABLE 2

| CROSSLINKER (5% dry wt) | CURE CONDITIONS | SOLVENT | FILM INTEGRITY |
|---|---|---|---|
| Example 1 | 2 min. 250° F. | DMF | fair |
| PEI-12 | 2 min. 250° F. | DMF | poor |
| Resimene 841 | 2 min. 250° F. | DMF | very poor |
| Example 1 | 2 min. 350° F. | DMF | good |
| PEI-12 | 2 min. 350° F. | DMF | fair |
| Reimene 841 | 2 min. 350° F. | DMF | poor |
| Example 1 | 6 days rt | toluene | fair |
| PEI-12 | 6 days rt | toluene | very poor |
| Resimene 841 | 6 days rt | toluene | very poor |

The vinyl chloride-ethylene copolymer emulsion and its mixtures with the diallylamine polymer, the polyethylenimine and the melamine-formaldehyde were evaluated as paper saturants at 10% solids applied to a commercial filter stock and dried for 7 minutes at 300° F.

TABLE 3

| | A-4514 | A-4514 5% Example 1 | A-4514 5% PEI 12 | A-4514 5% Resimene 841 |
|---|---|---|---|---|
| Percent Add-on | 16 | 16 | 16 | 17 |
| Tensile Strength, pli Cross Mach. Direction | | | | |
| Dry Test | 9.8 | 10.8 | 10.2 | 11.5 |
| Wet Test | 8.3 | 9.8 | 8.3 | 11.7 |
| MIT Fold | 650 | 610 | 670 | 410 |
| Scott Bond Cross Mach. Direction | 70 | 84 | 70 | 69 |

The data in Table 3 show that the diallylamine polymer containing composition was superior to the polyethylenimine containing composition in all saturation properties and superior to the melamine-formaldehyde containing composition in MIT fold and Scott bond tests. The MIT fold is a measure of flexural strength and the Scott bond test shows delamination resistance.

Unfortunately, the diallylamine polymers coagulate the vinyl chloride-ethylene copolymer emulsions unless the pH is adjusted to about 11 with sodium hydroxide. Because the binder composition was used at such a high pH, much of the saturation data using the polymer of Example 1 is probably lower than otherwise would be obtained. Sodium hydroxide reduces the paper's strength and compromises water resistance.

Two samples of diallylamine polymer prepared according to Example 1, a low molecular weight polymer and a high molecular weight polymer having a viscosity of 10 cps and 19 cps at 23% solids, respectively, were combined with Airflex®-4530 polymer emulsion which is a vinyl chloride-ethylene copolymer emulsion containing 50% solids and 12.5% ethylene based on copolymer marketed by Air Products and Chemicals, Inc.

TABLE 4

| | DRY PARTS CROSSLINKER pH DRY VCl-Et | | | | | | |
|---|---|---|---|---|---|---|---|
| | Example 1 (low mol. wt.) | | | | Example 1 (high mol. wt.) | | |
| | 0 | 4 | 8 | 12 | 4 | 8 | 12 |
| % Add-on | 13 | 13 | 13 | 14 | 15 | excessive pickup | |
| Tensile Strength, pli XMD | | | | | | | |
| Dry | 13.3 | 14.1 | 12.9 | 14.7 | 14.7 | | |
| Wet | 1.2 | 3.1 | 3.0 | 3.1 | 3.6 | | |
| Toluene | 1.6 | 3.6 | 4.1 | 4.0 | 3.4 | | |
| Mullen Burst, psi | | | | | | | |
| Dry | 28 | 27 | 27 | 30 | 32 | | |
| Wet | 0 | 4.0 | 3.4 | 5.2 | 8.9 | | |
| MIT Folds | 290 | 350 | 270 | 290 | 490 | | |
| Scott Bond | 43 | 51 | 50 | 52 | 78 | | |

Table 4 shows that low levels of both the low molecular weight and high molecular weight diallylamine polymers provided significant improvement in binder composition properties compared to the vinyl chloride-ethylene emulsion without crosslinker.

EXAMPLE 3

In this example various crosslinking agents were mixed with a vinyl chloride-ethylene copolymer emulsion prepared in the presence of polyvinyl alcohol as a protective colloid. The copolymer contained about 77% vinyl chloride, 18% ethylene and 5% polyvinyl alcohol.

TABLE 5

| | PVOH/VCl-Et 1.5% Glyoxal 40 0.26% Cycat 4040 | PVOH/VCl-Et 13% Resimene 841 0.26% Cycat 4040 | PVOH/VCl-Et 4.8% Ex. 1 (low mol. wt.) |
|---|---|---|---|
| Percent Add-on | 12.7 | 14.4 | 15.8 |
| Tensile Strength, pli, XMD | | | |
| Dry | 11.9 | 12.3 | 15.3 |
| Wet[b] | 4.5 | 5.0 | 5.3 |
| Toluene[c] | 5.5 | 6.2 | 6.4 |
| MEK[c] | 5.4 | 5.9 | 6.1 |
| IPA[c] | 9.3 | 9.9 | 11.1 |
| Hot[d] | 3.7 | 4.3 | 4.3 |
| Mullen burst, psi | | | |
| Dry | 25 | 26 | 37 |
| Wet[b] | 10 | 14 | 14 |
| Gurley Stiffness, MD | | | |
| Dry | 1310 | 1280 | 1470 |
| Wet[b] | 370 | 490 | 390 |
| MIT Folds | 1270 | 980 | 2560 |
| Scott Bond, XMD | 153 | 123 | 183 |
| Hot Oil Resistance by MIT Fold[e] | 1 | 1 | 1 |

[a]All saturants applied by Keegan size press at 8 fpm and dried at 380° F. Saturants at 10% solids. Formulations are dry on dry polymer weight. Base stock was a commercial filter grade.
[b]Wet samples boiled 10 min. before testing.
[c]Soaked 3 min. in solvent before testing.
[d]Heated to 175° F. with forced air gun.
[e]Soaked in motor oil for 96 hours at 300° F.
MEK = methylethyl ketone
IPA = isopropyl alcohol
XMD = cross machine direction
MD = machine direction
Glyoxal 40 is glyoxaldehyde marketed by Union Carbide.
Cycat 4040 is p-toluene sulfonic acid marketed by American Cyanamid.

When used with the polyvinyl alcohol/vinyl chloride-ethylene copolymer emulsion, diallylamine polymer offered better dry tensile and dry Mullen burst strength than the melamine-formaldehyde. MIT Folds and Scott Bond are significantly better with the diallylamine polymer. It should be noted that only 4.8 wt. % diallylamine polymer was used compared to 13 wt. % of the melamine-formaldehyde crosslinking agent.

STATEMENT OF INDUSTRIAL APPLICATION

The invention provides mixtures of chlorine-containing polymers and up to 25 wt. % N-heterocyclic-containing polyamines as binders for nonwovens.

I claim:

1. A binder composition for nonwovens comprising a chlorine-containing polymer which is a vinyl chloride homopolymer, a vinyl chloride copolymer, a vinylidene polymer or a chlorinated acrylic polymer and, as an amine crosslinking agent , up to 25 wt. % polyamine polymer which is the product of the polymerization of at least one diallylamine of the formula

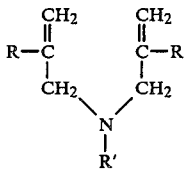

where R is hydrogen or a $C_1$–$C_4$ alkyl group and R′ is hydrogen or a methyl group.

2. The binder composition of claim 1 in which the polyamine is poly(diallylamine).

3. The binder composition of claim 1 in which the polyamine is present at 1 to 10 wt. %.

4. The binder composition of claim 1 in which the polyamine contains up to about 40 wt. % copolymerized vinyl acetate.

5. The binder composition of claim 1 in which the chlorine-containing polymer is a vinyl chloride/ethylene copolymer.

6. The binder composition of claim 5 in which the polyamine is poly(diallylamine).

7. The binder composition of claim 5 in which the polyamine is present at 1 to 10 wt. %.

8. The binder composition of claim 5 in which the polyamine contains up to 40 wt. % copolymerized vinyl acetate.

9. A nonwoven product comprising a nonwoven fibrous substrate bonded with 5 to 80 wt. % of the binder composition of claim 1.

10. A nonwoven product comprising a nonwoven fibrous substrate bonded with 5 to 80 wt. % of the binder composition of claim 2.

11. A nonwoven product comprising a nonwoven fibrous substrate bonded with 5 to 80 wt. % of the binder composition of claim 3.

12. A nonwoven product comprising a nonwoven fibrous substrate bonded with 5 to 80 wt. % of the binder composition of claim 4.

13. A nonwoven product comprising a nonwoven fibrous substrate bonded with 5 to 80 wt. % of the binder composition of claim 5.

14. A nonwoven product comprising a nonwoven fibrous substrate bonded with 5 to 80 wt. % of the binder composition of claim 6.

15. A nonwoven product comprising a nonwoven fibrous substrate bonded with 5 to 80 wt. % of the binder composition of claim 7.

16. A nonwoven product comprising a nonwoven fibrous substrate bonded with 5 to 80 wt. % of the binder composition of claim 8.

* * * * *